United States Patent [19]

Wolfe

[11] 4,103,379

[45] Aug. 1, 1978

[54] MARKER BUOY

[75] Inventor: Henry S. Wolfe, Clearwater, Fla.

[73] Assignee: American Clearwater Corp., Clearwater, Fla.

[21] Appl. No.: 831,941

[22] Filed: Sep. 9, 1977

[51] Int. Cl.[2] ..... B63B 21/52

[52] U.S. Cl. ..... 9/8 R; 9/9; 43/43.11

[58] Field of Search ..... 114/16.5; 9/8 R, 9; 254/167; 43/43.11; 242/54 R, 107.6

[56] References Cited

U.S. PATENT DOCUMENTS

| | | | |
|---|---|---|---|
| 3,037,217 | 6/1962 | Mandra | 9/8 R |
| 3,267,498 | 8/1966 | Pearson | 9/8 R |
| 3,441,962 | 5/1969 | Williams | 9/9 |
| 3,827,093 | 8/1974 | Davis | 9/9 |

*Primary Examiner*—Trygve M. Blix
*Assistant Examiner*—D. W. Keen
*Attorney, Agent, or Firm*—Hubbell, Cohen, Stiefel & Gross

[57] ABSTRACT

A marker buoy is provided with an inflatable body portion and a centrally disposed core portion. The core portion has a hub and side walls which define an annular recess about the marker buoy within which an anchor line can be wound. Resilient finger elements extend across the recess and act to prevent the anchor line from further unwinding after an anchor weight at the free end of the line unwinds the line to anchor the buoy. Drifting of the buoy from a selected location on the water's surface is thereby avoided.

8 Claims, 4 Drawing Figures

MARKER BUOY

BACKGROUND OF THE INVENTION

1. Field of the Invention

This invention relates generally to float markers, and more particularly to a marker buoy having an anchor line wound therearound which may be released to anchor the buoy at a selected location atop a body of water.

2. Description of the Prior Art

Marker buoys of the type on which an anchor line is wound and later paid out by way of an attached weight to anchor the buoy at a selected location are well known in the art.

For example, in the past, the captain of a fishing boat would throw over such a marker buoy the moment fish start biting. The buoy normally consisted of an old empty plastic water jug with line wound around it, and a sinker at the free end of the line to anchor the jug. Because the depth of water varies from one location to the next, it was not usually known how much line was required to be provided around the jug. Assuming that appreciably more line was provided than the actual depth of the water, the prior marker buoy would tend to drift away from the selected location of the water's surface after the anchor weight hit the bottom of the water. This drift may have been caused by tides, water currents and winds. Since there was nothing to prevent further unravelling of additional anchor line from these marker buoys, the buoy was free to drift until the total length of anchor line wound therearound was paid out. One way of avoiding this problem was for the fisherman to have several jugs with different lengths of wound line on board, or to have a depth finder that would tell him the depth of the water electronically so that he could determine how far the buoy had moved from the bottomed anchor.

The above problem of free drift of the anchored buoy has been overcome to an extent by certain buoys which provide particular restraining forces on the anchor line after the weight at the free end of the line bottoms and anchors the buoy.

For example, U.S. Pat. No. 3,827,093, issued Aug. 6, 1974, shows a spherical marking float having an annular groove formed about the periphery of its body. An anchor line is wound within this groove and a rubber band extending across the width of the groove is overlaid on the winding. According to the patent, the rubber band acts to maintain a predetermined tension on the anchor line as it unwinds from the float, and prevents further unwinding of the line from the float after the anchor weight bottoms out. It will be apparent that it is desirable to prevent such further unwinding of the anchor line, since the marking float would otherwise be free to drift from its initial location as explained above. However, it will also be realized that the use of a rubber band to inhibit further unwinding of the anchor line has certain disadvantages.

One major disadvantage in using the rubber band as taught in the 3,827,093 patent is that the band does not always exert enough of a retaining force on the anchor line to prevent further unraveling of the line in reasonably rough and choppy seas. This problem becomes even more acute upon deterioration and drying out of the rubber band under strong sunlight, excessive heat and salt spray. Also, it is of great importance that the band be properly placed in position about the wound line for proper operation of the patented buoy.

U.S. Pat. No. 3,441,962, issued May 6, 1969, also shows a float marker having an annular recess within which an anchor line is wound. The annular recess is defined by an elastic liner ring which opens outwardly to allow the line to unwind from within, while a predetermined retaining force is imparted to the line by way of the liner ring and both halves of the float marker, which act to compress the ring as the halves are tightened towards each other by a threaded rod and wing nut. It will be appreciated that as the anchor line unwinds from the liner ring, the retaining force imparted thereto may vary appreciably as the line continues to be withdrawn from within the ring and the volume of line within the ring decreases. Also, slight wear of the outer lips of the ring will greatly affect its ability to frictionally retard any free outward movement of the anchor line.

SUMMARY OF THE INVENTION

The above and other shortcomings in the prior self-anchoring marker buoys are overcome by the present invention, which provides a core portion centrally disposed in a body portion of buoyant material, the core portion having a hub and side walls defining an annular recess about the periphery of the marker within which an anchor line can be wound and stored. Extending across the recess are resilient finger elements, each of which is joined at one end to a side wall of the core. The finger elements allow the anchor line to unwind off of the hub while an anchor weight attached to the free end of the line sinks in a body of water and anchors the buoy. After the buoy is anchored, the finger elements prevent further unwinding of the anchor line in response to forces exerted on the marker buoy, as by the tides, winds and water currents.

The marker buoy of the present invention may be constructed as by joining two separate body half portions of buoyant material to both sides of a solid core portion, respectively. The present buoy may also be integrally constructed of a single buoyant material such as, for example, polyethylene.

In the event separate body portions are provided, they can be made to be inflatable for use and deflatable for easy storage of the buoy aboard a tight craft when the buoy is not being used.

It will be appreciated that the structure of the present buoy is advantageous in that elastic bands or liners are not used to provide control over the anchor line after the buoy is anchored. As noted above, such bands and liners are subject, to wear and deformation with continued use and exposure to the outside environment, thereby undergoing impairment of their intended functions and necessitating their frequent replacement. In contrast, the resilient finger elements provided in the present invention, which are not normally subjected to stresses giving rise to critical wear thereof, provide a reliable and inexpensive means for maintaining a marker buoy at a given location on the water's surface, and yet require no special care or frequent replacement.

DETAILED DESCRIPTION OF THE INVENTION

Figure 1:
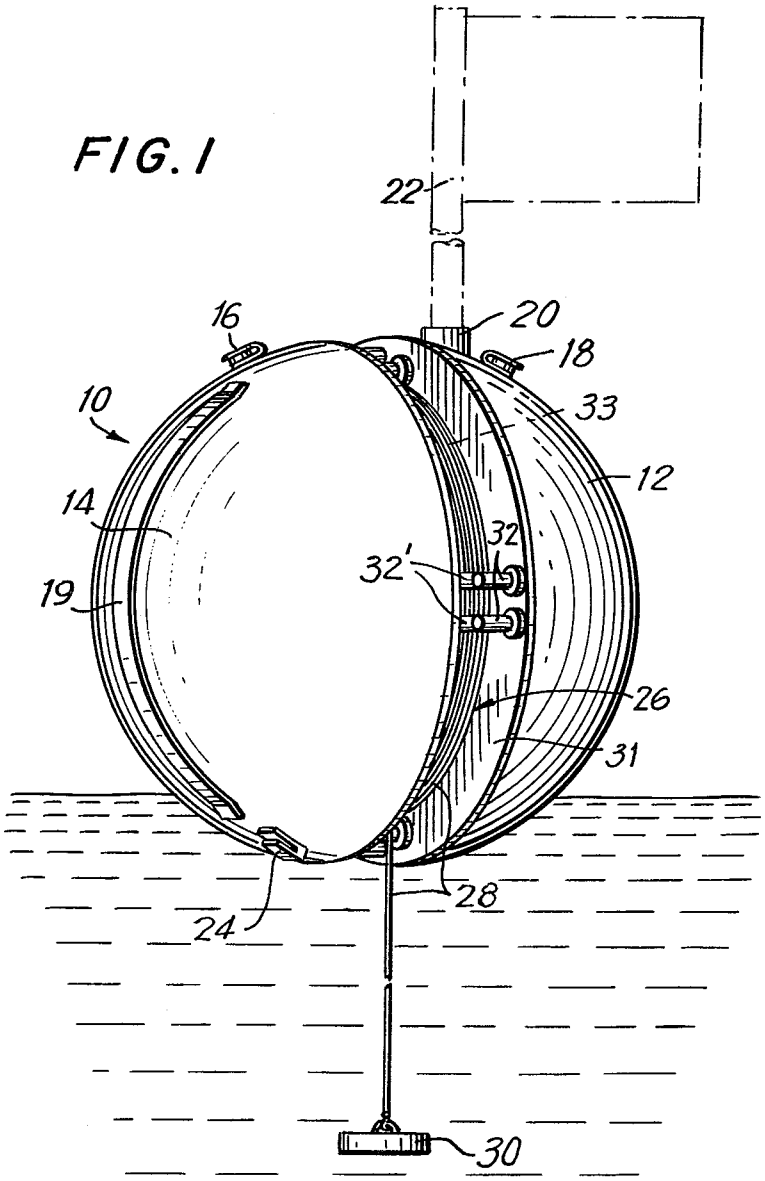
FIG. 1 is a perspective view of an embodiment of the present marker buoy floating atop a body of water with its anchor line paid out.

Referring now to the drawings and particularly to FIG. 1 thereof, designated generally by numeral 10 is an embodiment of the marker buoy according to the present invention. The buoy 10 comprises two generally hemispheric hollow body portions 12, 14, the body portions 12, 14 being inflatable and deflatable by way of valves 16, 18, respectively. The body portions 12, 14 are preferably made from inflatable vinyl material which is substantially impervious to extreme conditions such as, for example, long exposure to the sun, extreme heat and salt spray from ocean water. It is apparent that by providing the inflatable body portions 12, 14, the buoy of the present invention can be easily stored in tight quarters which are common on popular sized boats today. Such easy storage is possible even though the buoy, when fully inflated, can be made to be of substantially larger size than the prior art marker buoys discussed above.

A core portion 26, discussed later in detail in regard to FIG. 2, includes a central hub 33 and a pair of circular, spaced apart parallel side walls 31, 31' which are joined to the body portions 12, 14, respectively, preferably by heat sealing. The core portion 26, hub 33 and sidewalls 31, 31' are preferably made of solid vinyl having sufficient rigidity to support the inflated body portions 12, 14. An anchor line 28 is wound about the hub 33, one end of the line 28 being fixedly secured to the core portion 26 and the free end of the line being attached to an anchor weight 30.

Depending from the side walls 31, 31' are a series of pairs of resilient finger elements 32, 32', respectively, the elements 32, 32' making up each pair being also made from vinyl, although other flexible materials having the preferred weather resistance and degree of flexibility may also be used provided they perform as described below. The finger elements 32, 32' can be separately formed and thereafter heat sealed or otherwise joined to the side walls 31, 31', respectively.

Although the construction of the marker buoy 10 as described thus far calls for separate body portions 12, 14 and a core portion 26, it is understood that the buoy 10 including body portions 12, 14, core portion 26 and finger elements 32, 32' can also be integrally formed of a buoyant material such as, for example, polyethylene. In such case, the material used is preferably injection molded with the entire buoy 10 being made, for example, in two halves which are thereafter joined as by a suitable sealant.

Figure 2:
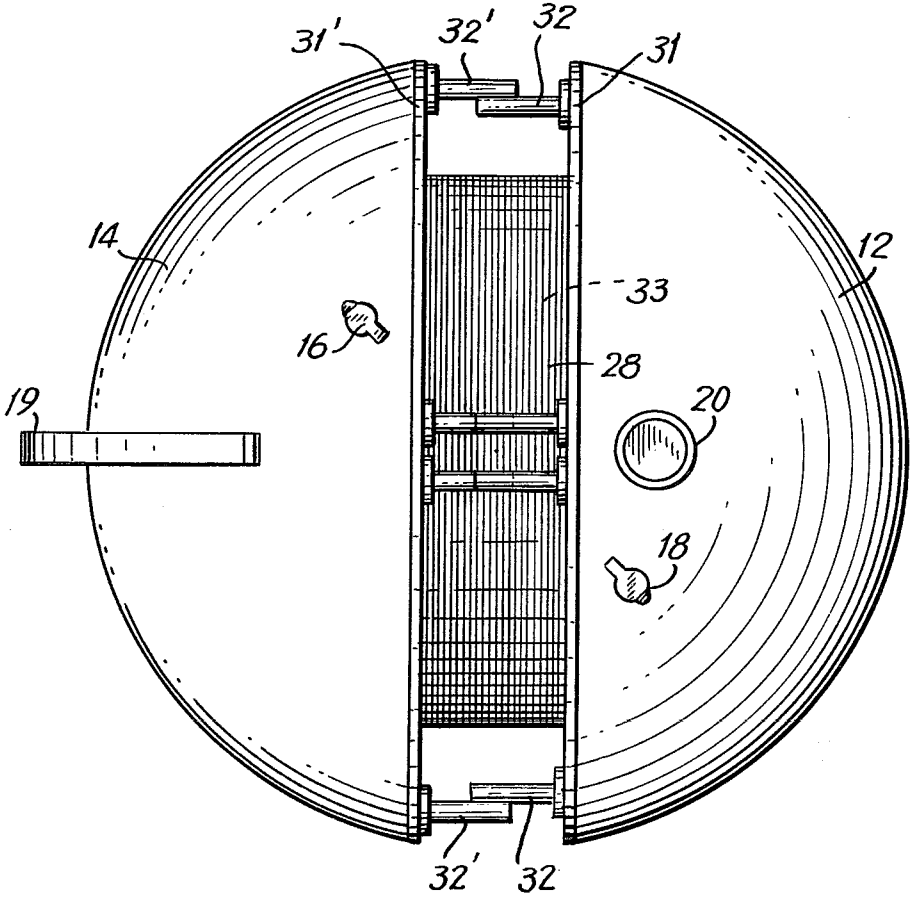
FIG. 2 is a side elevational view of a core portion provided on the marker buoy of FIG. 1.
Figure 3:
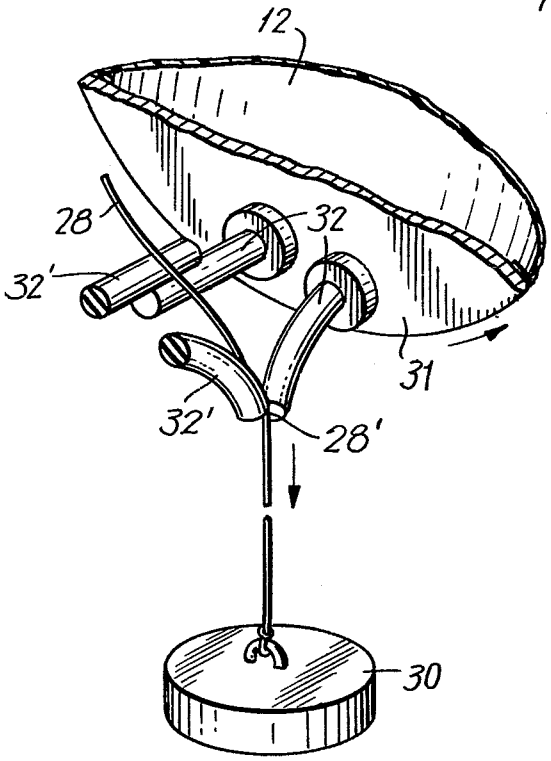
FIG. 3 is a detailed perspective view of the anchor line unwinding past finger elements disposed on the core portion of FIG. 2.

Referring now to FIG. 2, it is seen that the finger elements 32, 32' each extend across an annular recess defined by the circular side walls 31, 31', and the central hub 33 upon which the anchor line 28 is wound as shown in FIG. 1. It will be seen that the finger elements 32, 32' are preferably arranged to normally overlie and abut one another, respectively. Thus, the anchor line 28 may not unwind from the hub 33 to pass out beyond the top of the recess defined by the hub 33 and side walls 31, 31', unless a sufficient force is exerted thereon to pull the line against and past successive pairs of finger elements 32, 32'. As shown in FIG. 3, the anchor line 28, unwinding from the hub 33 of the core 26, can be pulled against and past the finger elements 32, 32', as by, for example, the anchor weight 30 as it descends through a body of water while the marker buoy freely rotates on the surface of the water. The finger elements 32, 32' are sufficiently resilient to permit their flexure as shown in FIG. 3 when the anchor line 28 is pulled outwardly to unwind, as described, or when the anchor line 28 is pulled inwardly as to rewind the line onto the core by hand as later described. Each of the finger elements 32, 32' flex until the anchor line 28 slips past the elements 32, 32' when at a position such as shown at 28'. Thus, an important feature of the present invention is the provision of the finger elements 32, 32' which elements have sufficient resiliency to flex and permit the anchor line 28 to unwind therepast in response to a predetermined force such as that supplied by the anchor weight 30, or by hand pressure as exerted during the rewinding process, but which elements have sufficient stiffness when in their straight extended positions to prevent the anchor line 28 from further unwinding when lesser forces such as winds, tides and water currents are applied to the marker buoy 10 at the water's surface.

Again referring to FIG. 1, body portion 14 includes an elongated strap handle 19, the handle 19 being securely affixed to the body portion 14 at its ends as shown. The strap handle 19 allows a user to easily hold the marker buoy 10 in a fixed position with one hand, while rewinding the anchor line 28 onto the hub 33 of the core portion 26 which is joined to each of the body portions 12, 14.

A line clip 24 is also provided on body portion 14 at a location opposite to a flagpole holder 20, the holder 20 being provided on the other body portion 12. A flagpole 22 can be inserted in the pole holder 20 to display, for example, the recognized divers' flag. It will, of course, be apparent that the marker buoy 10 must maintain the attitude shown in FIG. 1 so that the flagpole 22 is held in an upright position. This is accomplished by passing the anchor line 28 through the line clip 24 as shown and discussed later in regard to FIG. 4.

A flag such as the presently recognized divers' warning flag can be inserted within the holder 20 by a diver while in the water, as explained later below. The standard divers' warning flag has a blaze orange background with a black cross. Thus, if the operator of a passing boat should see such a flag in the water, he or she should exercise proper caution owing to the presence of divers beneath the water's surface in that area.

It will be understood that the marker buoy of the present invention has uses other than in fishing and alerting others to the presence of divers in the area, as noted above, and that the flag 22 is shown only for purposes of illustration of one such use. In fact, the marker buoy of the present invention may be properly used by police and rescue crews in salvage work, drownings, etc., or any other use where it is necessary to mark a specific location on the surface of a body of water.

Figure 4:
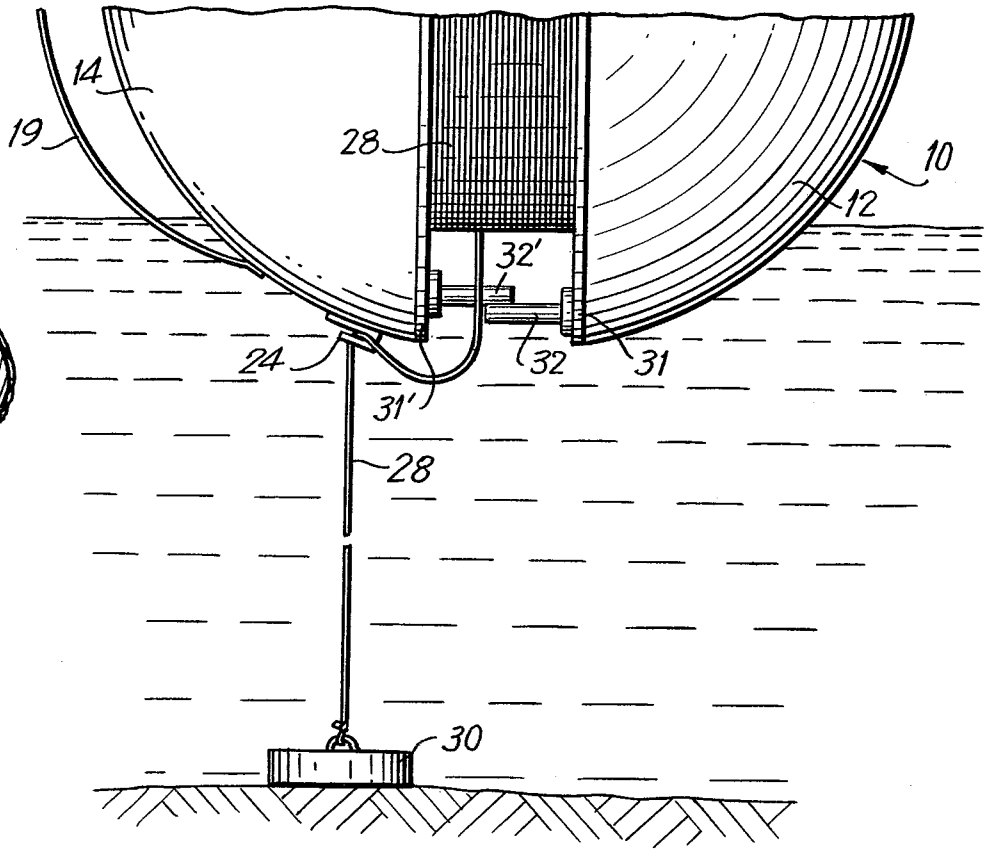
FIG. 4 is a side elevational view of the lower portion of the marker buoy with the paid out anchor line engaging a retaining clip on the body of the buoy.

In FIG. 4, the anchor line 28 is shown paid out from the marker buoy 10 by way of the anchor weight 30, and secured to the marker buoy 10 by way of the line clip 24 which is affixed to the body portion 14. As noted above, the provision of the line clip 24 and the flagpole holder 20 (FIG. 1) make the present marker buoy 10 especially useful for skin or scuba divers. For example, a diver, after locating the area in which he or she wants to operate, throws the marker buoy 10 overboard. After the anchor weight 30 unwinds as much of the anchor line 28 as is necessary to reach the water's bottom, the diver then enters the water and swims toward the marker buoy 10. Taking some of the anchor line 28 that is still wound about the hub 33 of the core portion 26, the diver inserts the line through the slit opening provided on the marker clip 24, thereby pulling the clip 24 downwardly to bring the marker buoy 10 to an orientation in which flagpole holder 20 is maintained in an upright position.

After the anchor line 28 is inserted in the line clip 24, the flagpole 22 is then inserted by the diver into the flagpole holder 20, whereupon the diver's flag will be prominently displayed and maintained in an upright position for ready observation by boat operators in the vicinity. If desired, the marker buoy 10 may also have the recognized skin divers' emblem or flag imprinted, in color, on one or both of the body portions 12, 14.

After the marker buoy 10 has been used to mark a particular location, it may be retrieved and prepared for storage or used to mark another location. The user merely retrieves the marker buoy 10 from the water's surface by way of, for example, the strap handle 19 (FIG. 1). The paid out anchor line 28 is rewound about the hub 33 of the core portion 26 by the user by holding the strap handle 19 in one hand and rewinding the anchor line 28 with the other hand. As already stated, the finger elements 32, 32' have sufficient resiliency to permit the anchor line 28 to bend them and slip past them when an ordinary winding force is applied to the line 28 by the user. It will be understood that after the anchor line 28 is fully wound on the hub 33 of the core portion 26, a sufficient amount of the line 28 should be left free to be inserted through and wound several times about the line clip 24 to prevent the line from inadvertent unwinding off from the marker buoy 10, especially if the anchor weight 30 is left attached at the free end of the line 28.

It will, of course, be appreciated that a number of variations and modifications of the present invention may be envisioned by one of ordinary skill in the art without departing from the spirit and scope thereof.

For example, if storage space is not a critical factor, the body portion 12, 14 may be solid rather than inflatable as described. In such case, each of the portions 12, 14 can be made of styrofoam or other sufficiently buoyant materials, or the entire buoy can be made of a single material as by, for example, injection molding as noted above.

Further, the overall shape of the marker buoy 10 need not be spherical as shown, but may be of a symmetrical shape such as would freely rotate about an axis parallel to the surface of the water on which the marker buoy 10 floats. Thus, for example, a generally cylindrical shape for the body of the buoy 10 wound suffice wherein the core portion 26 would be disposed centrally within the cylindrical body.

Additionally, the resilient finger elements 32, 32' need not be arranged in the particular configuration shown, but may extend the entire distance between the side walls 31, 31' of the core portion 26 and, further, may interleave one another rather than overlie each other as shown, although the present configuration of the finger elements 32, 32' is preferred.

It is therefore intended that all such obvious modifications and variations, including but not limited to those expressly stated above, be deemed to be within the spirit and scope of the present invention as defined in the appended claims.

What is claimed as new and desired to be secured by Letters Patent is:

1. A marker buoy for marking a selected location on the surface of a body of water having a particular depth at said location, said marker buoy comprising:

a body portion of buoyant material operative to float said buoy on said water surface, said body portion being free to rotate on said water's surface about an axis substantially parallel to said surface;

a core portion centrally disposed in said body portion, said core portion having a central hub and opposed sidewalls overextending said hub to define an annular recess about the periphery of said marker buoy, the axis of said hub being substantially coincident with the rotational axis of said body portion;

an anchor line for winding and unwinding movement within said recess about said hub when one end of said line is fixedly secured to said marker buoy, the other end of said line being free to engage an anchor weight operative to sink in said body of water and to unwind said line until a length of said line corresponding to said particular depth is unwound to anchor said marker buoy; and a plurality of resilient finger elements each being fixedly mounted at one end to one of said core portion sidewalls and extending across said recess towards the opposite sidewall;

whereby when said anchor weight is secured to said free end of said line and descends in said water and unwinds said line to anchor said buoy, said line is pulled against said successive finger elements, and after said buoy is anchored, said finger elements prevent said line from further unwinding from said buoy.

2. A marker buoy according to claim 1, wherein said body portion comprises two separate half body portions and each of said sidewalls of said core portion is fixedly joined to one of said half body portions, respectively.

3. A marker buoy according to claim 2, wherein each of said half body portions is inflatable and has a generally hemi-spherical shape when inflated.

4. A marker buoy according to claim 1, wherein first resilient finger elements disposed on one of said sidewalls are in oppositely facing confronting relationship with corresponding second finger elements disposed on the other one of said sidewalls.

5. A marker buoy according to claim 4, wherein said first finger elements partially overlie and abut respective second finger elements.

6. A marker buoy according to claim 1, further comprising clip means mounted on said marker buoy for securing said unwound anchor line to said marker buoy.

7. A marker buoy according to claim 6, further comprising means mounted on said marker buoy for receiving the bottom of a flagpole and for supporting same in an upright position when said marker buoy is anchored and said unwound anchor line is secured by said clip means to said marker buoy.

8. A marker buoy according to claim 1, wherein said body portion, said core portion and said finger elements are integrally formed.

* * * * *